US007202840B2

(12) United States Patent
Kato

(10) Patent No.: US 7,202,840 B2
(45) Date of Patent: Apr. 10, 2007

(54) METHOD FOR DRIVING AN ORGANIC ELECTROLUMINESCENT DISPLAY DEVICE

(75) Inventor: Naoki Kato, Kanagawa (JP)

(73) Assignee: OPTREX Corporation, Tokyo (JP)

( * ) Notice: Subject to any disclaimer, the term of this patent is extended or adjusted under 35 U.S.C. 154(b) by 491 days.

(21) Appl. No.: 10/724,124

(22) Filed: Dec. 1, 2003

(65) Prior Publication Data

US 2004/0160393 A1 Aug. 19, 2004

(30) Foreign Application Priority Data

Dec. 2, 2002 (JP) ..... 2002-350519

(51) Int. Cl.
*G09G 3/30* (2006.01)
*G09G 3/32* (2006.01)

(52) U.S. Cl. ..... 345/76; 345/82

(58) Field of Classification Search ..... 345/76–83
See application file for complete search history.

(56) References Cited

U.S. PATENT DOCUMENTS 6,774,878 B2 * 8/2004 Yoshida et al. ..... 345/76
6,914,388 B2 * 7/2005 Shin et al. ..... 315/169.2
7,019,720 B2 * 3/2006 LeChevalier ..... 345/82

FOREIGN PATENT DOCUMENTS

| | | |
|---|---|---|
| JP | A-9-232074 | 9/1997 |
| JP | A-11-045071 | 2/1999 |
| JP | A-2000-036390 | 2/2000 |

* cited by examiner

*Primary Examiner*—Dennis-Doon Chow
(74) *Attorney, Agent, or Firm*—Oblon, Spivak, McClelland, Maier & Neustadt, P.C.

(57) ABSTRACT

In a selection period for applying a selection voltage to a scanning strip, a high impedance section for placing a data strip in a high impedance state is provided after a constant current section for supplying a constant current to a data strip from a constant current circuit. An organic electroluminescent element to be used has a small voltage-dependency in luminous efficiencies. When performing grayshade display by PWM, a data strip is supplied with an amount of electric charges from the constant current circuit in the constant current section, the amount of electric charges being calculated by adding an amount of residual electric charges in pixels to an amount of electric charges corresponding to luminance required for respective gray scale levels, the amount of residual electric charges being found based on an estimated potential at the data strip at end of the high impedance section.

8 Claims, 12 Drawing Sheets

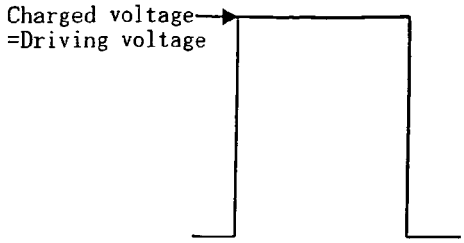
Fig. 13 A
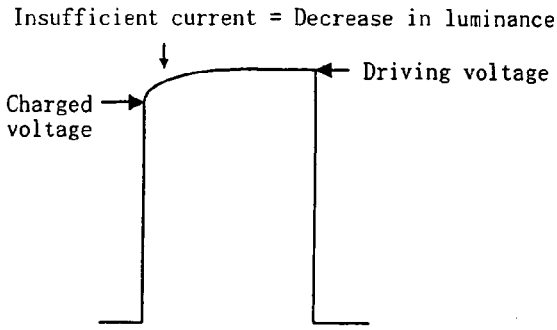
Fig. 13 B
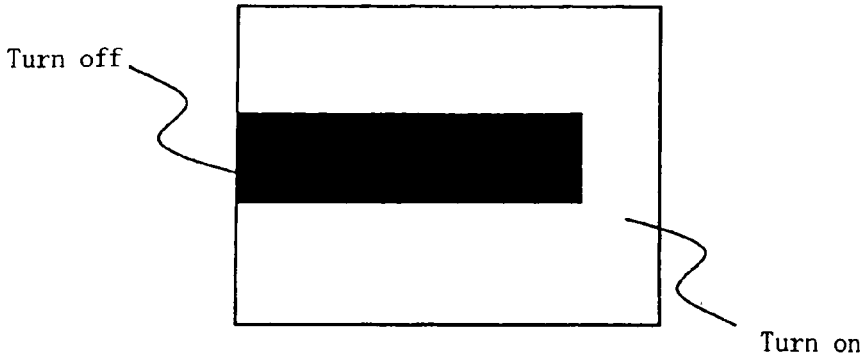
Fig. 14 A Image to be displayed
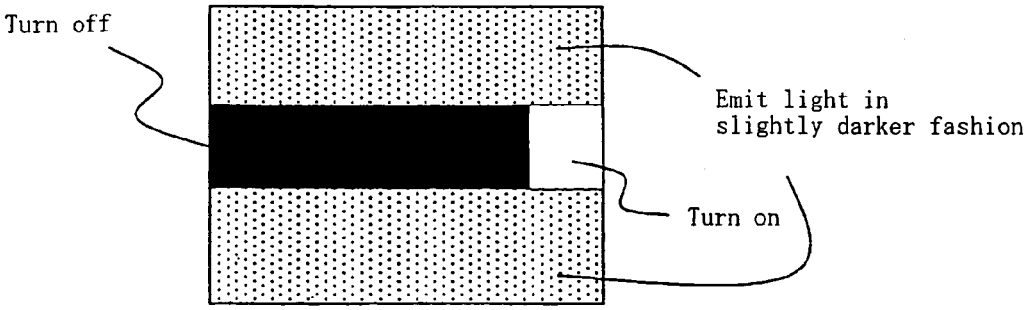
Fig. 14 B Actually displayed image

METHOD FOR DRIVING AN ORGANIC ELECTROLUMINESCENT DISPLAY DEVICE

BACKGROUND OF THE INVENTION

1. Field of the Invention

The present invention relates to a method for driving an organic electroluminescent display device, which uses an organic electroluminescent light emitting element (hereinbelow, referred to as organic electroluminescent element).

2. Discussion of Background

An organic electroluminescent element has an organic thin film provided between an anode and a cathode. The organic thin film, which is sandwiched between both electrodes, has unnegligible capacitance formed therein. The organic electroluminescent element has properties similar to semiconductor light emitting diodes. When the anode side of the thin film is provided on a higher voltage side, and when a certain voltage is applied across both electrodes, the organic electroluminescent element emits light. Conversely, when the cathode side of the thin film is provided on a higher voltage side, the organic electroluminescent element does not emits light since almost no current flows. For this reason, the organic electroluminescent element is also called an organic light emitting diode in some cases.

When a constant voltage is applied across the thin film of an organic electroluminescent element, the luminance of the organic electroluminescent element greatly varies, depending on a change in temperature or a change with time. However, the width of variations in the luminance of an organic electroluminescent element is small with respect to the value of currents. In order to obtain required display intensity, it is common to use a constant-current drive wherein a constant-current circuit is provided in a driving circuit to supply a constant current to respective organic electroluminescent elements.

An organic electroluminescent display device, which has an organic electroluminescent element provided in each of pixels of matrix electrodes, is available. FIG. 9(*a*) and FIG. 9(*b*) are a schematic perspective view and a schematic cross-sectional view of the organic electroluminescent display device. There are provided a set of anode strips 2 connected to an anode or forming an anode per se, and a set of cathode strips 1 connected to a cathode or forming a cathode anode per se, which extend in a direction perpendicular to the anode strips. An intersection between a cathode strip 1 and an anode strip 2 forms a pixel, and an organic thin film 3 is sandwiched between both electrodes. In this manner, pixels, which are formed by organic electroluminescent elements, are provided in a matrix fashion and in a planar fashion on a glass substrate 4.

A technique for performing display of an organic electroluminescent display device by passive matrix addressing will be explained. In explanation below, one of the set of the cathode strip 1 and the set of the anode strip 2 works as scanning strips, and the other works as data strips. Respective scanning strips are connected to a scanning driver, which is provided with a constant-current circuit. By this arrangement, constant-current drive is performed with respect to the scanning strips. The scanning strips are sequentially scanned so that one of the scanning strips is in a selected state with a selection voltage applied and the remaining scanning strips are in a non-selected state without the selection voltage applied. In general, the scanning strips are sequentially scanned to have a certain drive voltage applied thereto from the scanning strip at one end of the set of the scanning strips to the scanning strip at the other end so that one scanning strip has the selection voltage applied thereto in every selection period and so that all scanning strips are scanned in a certain period.

The data strips are connected to a data driver, which has a constant-current circuit provided at an output stage. Display data, which correspond to the display pattern of selected scanning strips, are supplied to all data strips in synchronization with the scanning of the scanning strips. A current pulse, which is supplied to the data strips from the constant-current circuit, flows in a selected scanning strip through organic electroluminescent elements, which are located at the intersections between the selected scanning strip and the data strips.

The pixel of an organic electroluminescent element emits light only in a period wherein the scanning strip with that pixel connected thereto is selected and there is current supply from the data strip. When the current supply from the data strip stop, the light emission also stops. While a current supply is made to the organic electroluminescent elements sandwiched between the set of the data strips and the set of the scanning strips in this manner, all scanning strips are sequentially scanned in a repetitive fashion. In accordance with a desired display pattern, the emission and the non-emission of light is controlled with respect to the pixels of the entire display screen.

For driving the organic electroluminescent elements, the set of the anode strips 2 and the set of the cathode strips 1 of the organic electroluminescent elements may be set so that one of the sets works as the scanning strips or the data strips. In other words, the anode strips 2 are used as the scanning strips while the cathode strips 1 are used as the data strips. Or, the anode strips 2 are used as the data strips while the cathode strips 1 are used as the scanning strips. Both sets of the electrodes have interchangeability in terms of driving the organic electroluminescent elements. Generally, it is common that the data scanning strips correspond to the anode strips 2 and the scanning strips correspond to the cathode strips 1. Hereinbelow, explanation of the driving and the display of the organic electroluminescent display device will be made about a case wherein the cathode strips 1 works as the scanning strips and the anode strips 2 work as the data strips. In explanation below, the array of pixels that extend parallel with the scanning strips will be also called "row", while the array of pixels that extend parallel with the data strips will be also called "column".

First, the scanning strips, which are connected to the cathode for the organic electroluminescent elements, need to satisfy the following electric potential condition. Specifically, the potential of a scanning strip in the selected state need to be lower than the potential of a scanning strip in the non-selected state. For the purpose, driving is performed so that the potential of a scanning strip in the selected state is set at ground (earth) potential so as to provide a scanning strip in the non-selected state with a higher potential than the ground potential.

The data strips on the column side are supplied with a constant current when output data are turn-on data for turning on a pixel. The data strips on the column side are supplied with a constant voltage equal to ground potential when output data are turn-off data for turning off a pixel. In other words, the data strips are configured so as to be switched between a constant-current output and a constant voltage output, depending on whether a pixel is turned on or off. The reason why the data strips are supplied with the constant current output is that the luminance is controlled by the value of a current as stated earlier.

The direction of a current, which flows in an organic electroluminescent element, is set so that the current flows from the data strip as an anode strip 2 to the scanning strip as a cathode strip 1 through the organic thin film 3. For this reason, the potential of the data strips is set so as to be higher than ground potential as the potential of a scanning strip in the selected state.

As shown in the equivalent circuit diagram of FIG. 10, organic electroluminescent elements exhibit not only an electrical property as diodes but also a capacitive characteristic. By supplying the current into a desired pixel from the data driver having the constant-current circuit, light is emitted from the pixel of an organic electroluminescent element, which is in a row with the selection voltage applied thereto. However, the pixels that are in non-selected rows without the selection voltage applied thereto simultaneously need to be capacitively charged.

When the number of the pixels of an organic electroluminescent element, which are connected to one data strip, increases according to an increase in the number of rows of the matrix forming a display screen, the current required for charging the capacitance of all pixels reaches an unnegligible value. As a result, the current that flows in a pixel in a row with the selection voltage applied thereto decreases to provide the luminance with a lower value than the expected value.

In order to solve this problem, two driving methods have been proposed. A first method is reset driving. When driving is switched from one scanning strip to the next one, all scanning strips are set at an equal potential once, and then charging is started at the equal potential for driving (e.g., JP-A-9-232074, paragraph 0024 to paragraph 0032 and FIG. 1 to FIG. 4).

The second method is precharge driving. A charging circuit is additionally provided on the data driver side, and the respective pixels of an organic electroluminescent element are precharged for a certain time period. The luminance is improved by increasing the driving voltage for the organic electroluminescent elements (e.g., JP-A-11-45071, paragraph 0022 to paragraph 0029 and FIG. 2).

Hereinbelow, previously setting all scanning strips at an equal potential once or previously charging the respective pixels of an organic electroluminescent element will be referred to "the capacitive charge".

FIG. 12 shows a basic driving waveform in a case wherein the display pattern shown in FIG. 11 is displayed on a 4×4 matrix display screen having pixels positioned in columns C1, C2, C3 and C4 and in rows R1, R2, R3 and R4. Now, the driving method wherein the time width of an output current pulse from the data driver is modified will be explained.

As shown in FIG. 12, the current pulse is supplied so as to have a pulse width occupying substantially the full width of the selection period with respect to a pixel, which is required to emit light with the maximum luminance (a luminance of 100%). The current pulse is supplied so as to have a pulse width occupying a half width in comparison with the case of a luminance of 100% with respect to a pixel, which is required to emit light with a luminance of 50%. This driving method is called a pulse width modulation (hereinbelow, also referred to as PWM).

In the structure of an organic thin film 3 wherein a light emitting layer has a hole transport layer provided on the anode side of in layer, and wherein the hole transport layer and the anode have a hole injection layer interposed therebetween in layer, the hole injection layer may be made of copper phthalocyanine. It has been reported that the hole injection layer can be made of an organic polymeric material to improve the property of an organic electroluminescent display (e.g., JP-A-2000-36390).

In the conventional driving methods, pixels are actually driven after capacitive charge. When the voltage that is applied to the pixels at the time of completion of capacitive charge (charged voltage) fails to reach the voltage that is applied to the data strips at the time of driving a pixel (driving voltage), the difference between the charged voltage and the driving voltage causes a decrease in luminance in some cases. FIG. 13(*a*) shows an example of the applied voltage, which is applied to a pixel to emit light with a luminance of 100% or a luminance of nearly 100%. In FIGS. 13(*a*) and 13(*b*), the time period for supplying a constant current is indicated in the horizontal direction, and an applied voltage is indicated in the vertical direction. The rising edge of each applied voltage is the time when capacitive charge has been completed.

When the charged voltage has the same value as the driving voltage as shown in FIG. 13(*a*), selected pixels have a desired current immediately flowing therethrough. However, when the charged voltage is lower than the driving voltage as shown in FIG. 13(*b*), other pixels in the same column that are not selected also have a current flowing therethrough even after completion of capacitive charge until the applied voltage has reached the value of the driving voltage. As a result, the pixels to emit light are short of electric charges, lowering the luminance. When the charged voltage is higher than the driving voltage, the other pixels in the same column that are not selected also have a current flowing out thereof into the selected pixels even after completion of capacitive charge. As a result, the selected pixels have an excessive amount of electric charges, increasing the luminance.

Since the cathode strips 1 have a certain level of resistance, the amount of the current that flows into the cathode strips varies depending on the number of pixels to emit light per one row. As a result, the cathode potential varies depending on the kind of a display pattern. Even when pixels emit light with a relatively high luminance, such as a luminance of 100% or a luminance of nearly 100%, chrominance non-uniformity is. caused in a horizontally striped shape according to a display pattern, depending on the kind of a display pattern and the difference between the charged voltage and the driving voltage, as shown in FIG. 14(*b*). This type of display state is called horizontal cross-talk. FIG. 14(*b*) shows a case wherein although an attempt is made to turn off a portion of the display screen and emit light from the remaining portions with a luminance of 100% as shown in FIG. 14(*a*), the luminance becomes darker than expected since the cathode potential in a row having a large number of pixels to turn on increases to prevent a certain current from flowing the organic electroluminescent elements forming the pixels to turn on.

When light emission is made with a low luminance by PWM, the problem of horizontal cross-talk becomes a big issue. FIGS. 15(*a*) and 15(*b*) show examples of the applied voltage for turning on a pixel by PWM. In FIGS. 15(*a*) and 15(*b*), the time period for supplying a constant current is indicated in the horizontal direction, and each applied voltage is indicated in the vertical direction.

When the charged voltage has the same value as the driving voltage as shown in FIG. 15(*a*), selected pixels have a desired current immediately flowing therethrough. However, when the charged voltage has a different value from the driving voltage as shown in FIG. 15(*b*), other pixels in the same column that are not selected also have a current flowing therethrough even after completion of capacitive charge until the applied voltage has reached the value of the driving voltage. When a pixel is energized to emit light with a low luminance as shown in FIG. 15(*b*), the time period for supplying a current to the relevant data strip ends before the applied voltage has reached the same value as the driving voltage. In this case, the pixel emits light with a lower luminance than a desired luminance (required luminance). When all pixels have the same current-voltage characteristics in an organic electroluminescent display device, the luminance of the device uniformly lowers over the entire screen. However, in a case wherein the pixels have different current-voltage characteristics, the respective pixels have different values of currents flowing therethrough to fail to provide a uniform luminance over the entire screen even when the pixels have the same voltage applied thereacross. The current-voltage characteristics of a pixel means the relationship between a voltage applied to a pixel and a current flowing through the pixel.

In a case wherein there are variations in the current-voltage characteristics, i.e., wherein pixels have different values of currents flowing therethrough by application of a single voltage, a pixel emits light with the required luminance and another pixel emits light with a lower luminance in spite of that all pixels to emit light are energized so as to emit light with the same luminance by constant-current drivel. As a result, there is caused chrominance non-uniformity wherein the luminance varies to portion from portion to such degree that can be visually recognized.

The degree of the horizontal cross-talk generated becomes greater than a case wherein desired pixels are energized to emit light with a luminance of 100% or a relative high luminance near to a luminance of 100%.

When capacitive charge is performed to all pixels in an organic electroluminescent display, additional power is required for capacitive charge. Even when a display pattern needs a small number of pixels to emit light, the power consumption for the organic electroluminescent display cannot be reduced to a lower value than the power consumption required for capacitive charge.

SUMMARY OF THE INVENTION

It is an object of the present invention to solve the problems stated earlier, to suppress the occurrence of horizontal cross-talk or chrominance non-uniformity in an organic electroluminescent display device and to reduce the power consumption required for the organic electroluminescent display device.

In order to attain the object, in a driving method according the present invention, special drive for capacitive charge, such as reset driving or precharge driving, is not performed, a driving section is set so as to have a shorter length than a selection period, and an amount of electric charges, which are supplied to pixels in the driving section in the selection period, is controlled so as to correspond to required luminance. In a driving method according the present invention, the electric charges that have been accumulated in the capacitance of the pixels in the driving period are controlled to be supplied to selected pixels in a non-driving period in the selection period. This form of driving method will be referred to as the electric charge control driving. When reset driving or precharge driving is not performed, an amount of currents that flow through the pixels is a period from start of drive to a time when an anode voltage has achieved a driving voltage is small, and the luminance is lower than an expected value in that period as stated earlier. However, it is possible to uniform the luminance amount in the selection period with respect to required luminance by controlling an amount of electric charges supplied to the pixels according to the required luminance. Thus, it is possible to reduce variations in luminance, and it is therefore possible to suppress the occurrence of horizontal cross-talk.

According to a first aspect of the present invention, there is provided a method comprising placing a data strip in a high impedance state after supplying a constant current to the data strip from a constant current circuit in the selection period for applying a selection voltage to a scanning strip, and providing an organic electroluminescent element, the organic electroluminescent element having luminous efficiencies with respect to currents flowing therethrough falling in a variation range in a range of voltages applied across an anode and a cathode of the organic electroluminescent element, the applied voltages ranging from a voltage applied at end of a rising time of voltage application to a voltage applied at end of the high impedance section in the selection period. An example of the variation range is 15%.

According to a second aspect of the present invention, there is provided a method comprising placing a data strip in a high impedance state after supplying a constant current to the data strip from the constant current circuit in the selection period for applying a selection voltage to a scanning strip, performing grayshade display by PWM, and supplying an amount of electric charges to the data strip in a constant current section when pixels emit light at respective gray scale levels, the amount of electric charges being calculated by adding an amount of residual electric charges to an amount of electric charges corresponding to luminance required for the respective gray scale levels, the amount of residual electric charges being found based on an estimated potential at the data strip at end of the high impedance section. In accordance with the second aspect, it is possible not only to obtain a desired luminance but also to suppress the occurrence of chrominance non-uniformity and horizontal cross-talk even in the case of a low gray scale level.

In the method according to a third aspect of the present invention, the method further comprises varying the added amount of electric charges according to ambient temperature of the organic electroluminescent element in the second aspect.

In the method according to a fourth aspect of the present invention, the organic electroluminescent element has luminous efficiencies to currents flowing therethrough falling in a variation range of 15% in a range of voltages applied across between an anode and a cathode of the organic electroluminescent element, the applied voltages ranging from the voltage applied at end of the rising time to the voltage applied at end of the high impedance section in the selection period in any one of the first to third aspects. In accordance with the fourth aspect, it is possible to obtain a uniform luminance even when the applied voltages greatly vary in the selection period.

In the method according to a fifth aspect of the present invention, the organic electroluminescent element has a hole injection layer, which contains 50 wt % or more of organic polymeric material having a weight-average molecular weight of 1,000 or more in the fourth aspect. In accordance with the fifth aspect, it is possible to provide the electroluminescent element with a small voltage-dependency in luminous efficiencies with respect to currents flowing therethrough.

In the method according to a sixth aspect of the present invention, the method further comprises setting a frame frequency at 120 Hz or lower and a duty ratio at 1/32 to 1/28, and setting a length of the high impedance section at (1/duty ratio) μs or longer in any one of the first to fifth aspects. In accordance with the sixth aspect one example of the range wherein the driving method according to the present invention can be effectively utilized is specified.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 13(*a*) and 13(*b*) are waveform diagrams showing examples of voltages applied to a pixel according to conventional method;

FIGS. 14(*a*) and 14(*b*) are explanatory diagrams showing how horizontal cross-talk is caused.

DETAILED DESCRIPTION OF THE PREFERRED EMBODIMENTS

Figures 1A, 1B:
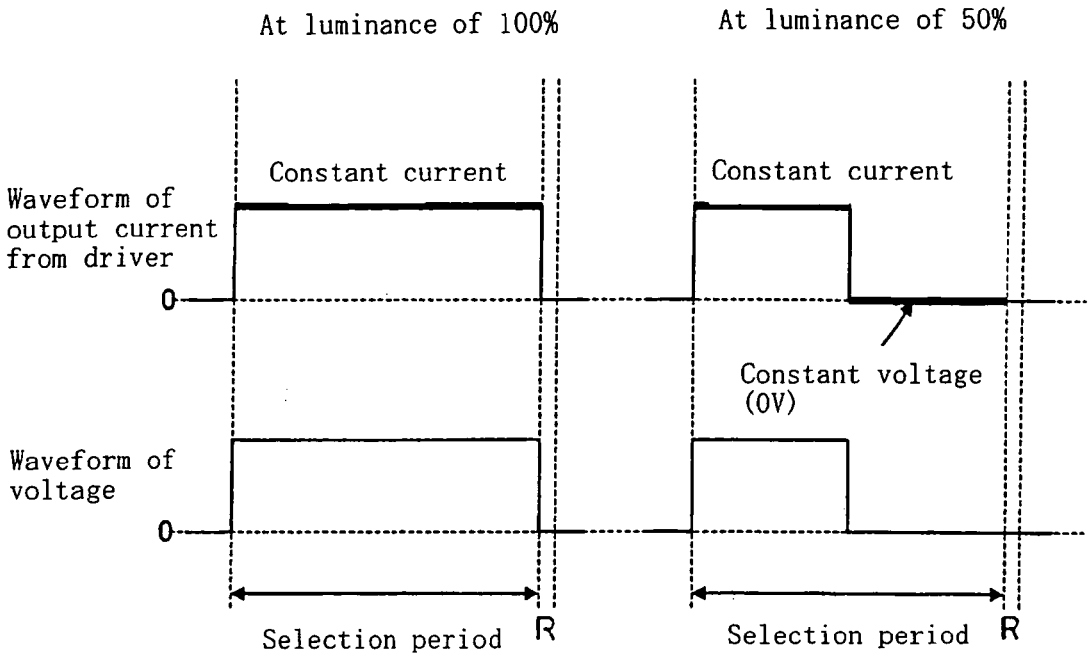
FIGS. 1(*a*) to 1(*d*) are schematic views showing electric charge control driving according to the present invention in comparison with conventional method.
Figures 1C, 1D:
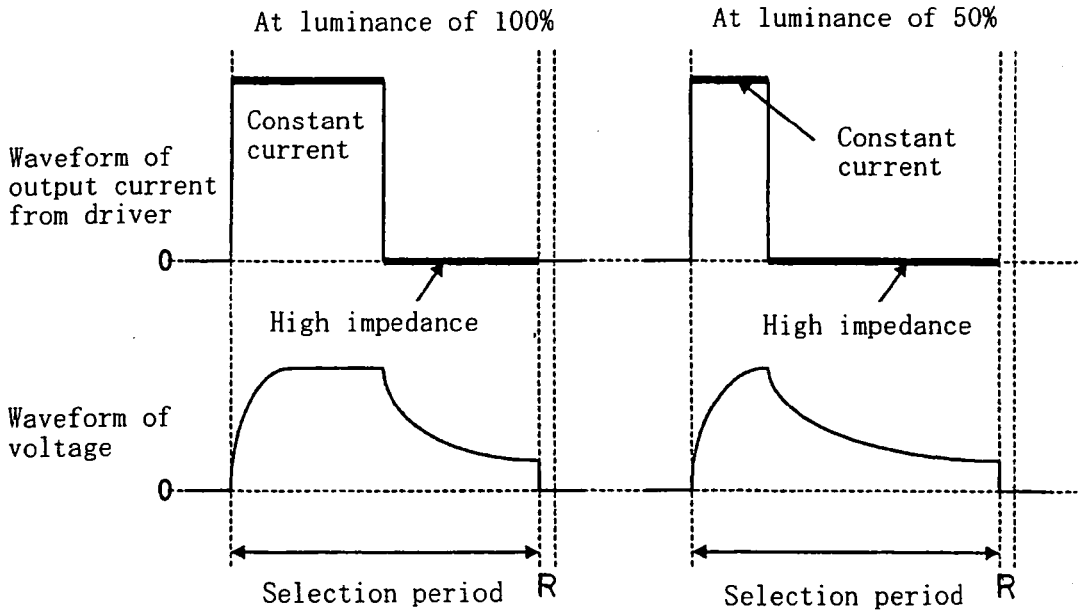
Figure 2:
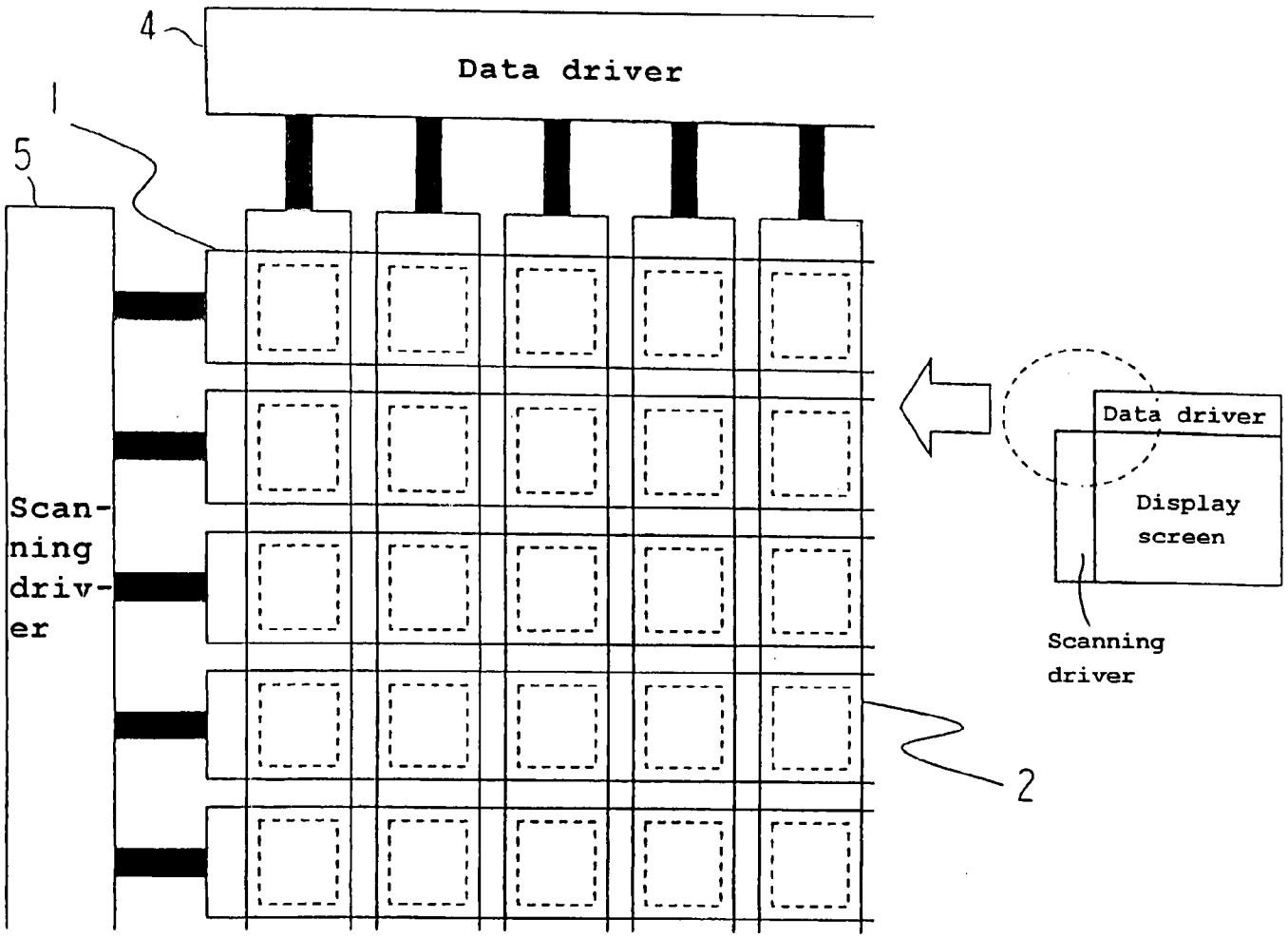
FIG. 2 is a schematic view showing how electrodes are provided in an organic electroluminescent display device.
Figure 3:
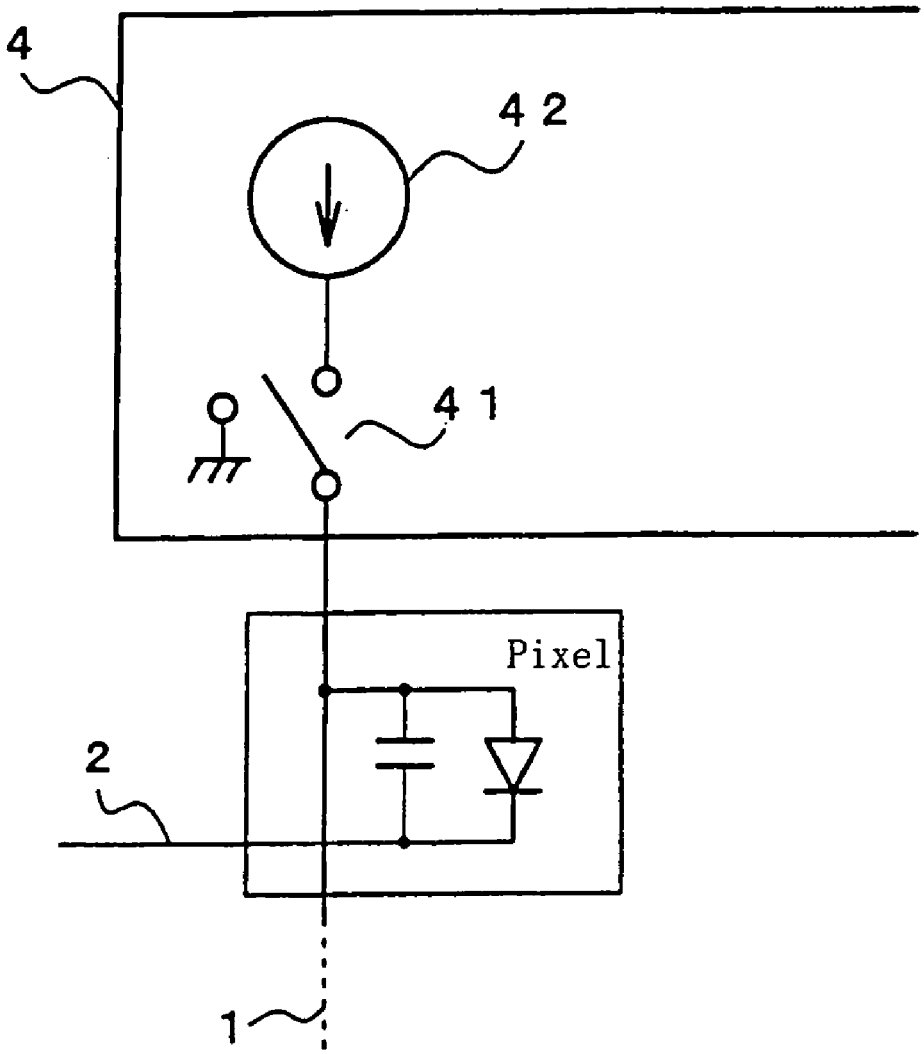
FIG. 3 is a schematic view showing the driving portion for one column in a data driver and a pixel connected to the driving portion.

Now, an embodiment according to the present invention will be described, referring to the accompanying drawings. FIGS. 1(*a*) to 1(*d*) are schematic views showing the electric charge control driving according to the present invention in comparison with conventional method. FIG. 2 is a schematic view showing how electrode strips are provided in an organic electroluminescent display device. FIG. 3 is a schematic view showing the driving portion for one column in a data driver and pixels. In these figures, FIGS. 1(*a*) and 1(*b*) show the conventional method using PWM, and FIGS. 1(*c*) and 1(*d*) show the electric charge control driving according to the present invention using PWM. In FIGS. 1(*a*) to 1(*d*), "R" designates an idle period between a selection period and the next selection period. In FIGS. 1(*a*) to 1(*d*), an upper half section shows the waveform of an output current from the data driver 4, and a lower half section shows the waveform of an anode voltage (the waveform of a voltage of anode strips).

Referring to FIG. 2, the data driver 4 provides a constant current to anode strips 2 as data strips on driving, and a scanning driver 5 provides a selection voltage to cathode strips 1 as scanning strips to be selected. As shown in FIG. 3, the anode strips 2 as the data strips can take any one of a state to be connected to a constant-current circuit 42, a state to be connected to ground potential and a state to be disconnected from either one (a high impedance state), by a switching element 41. The anode strips are connected to ground potential only in the idle period. The driving period for supply of a constant current and the time period in the high impedance state shown in FIGS. 1(*c*) and 1(*d*) are called a constant current section and a high impedance section in some cases, respectively.

In the conventional driving method, when pixels are energized to emit light with a luminance of 100% by passive matrix addressing, a selected pixel (a pixel connected to a cathode strip 1 with the selection voltage applied thereto) is provided with a constant current from the beginning to the end of a selection period after completion of capacitive charge as shown in FIG. 1(*a*). When pixels are energized to emit light with a luminance of 50%, a selected pixel is provided with the constant current in a section occupying 50% of the selection period, and the anode strip 2 is at ground potential to prevent the selected pixel from being energized in the remaining section occupying 50% of the selection period as shown in FIG. 1(*b*).

In accordance with the electric charge control driving, when pixels are energized to emit light with a luminance of 100% by passive matrix addressing, the switch 41 is placed in the state to connect the constant-current circuit 42 and the anode strip 2 to provide a selected pixel with a constant current in a certain section in a selection period as shown in FIG. 1(*c*). In the remaining section of the selection period, the switch 41 is placed in the state to disconnect the constant-current circuit 42 and the anode strip 2 to place the anode strip 2 in the high impedance state.

On the other hand, when pixels are energized to emit light with a luminance of 50%, the switch 41 is placed in the state to connect the constant-current circuit 42 and the anode strip 2 to provide a selected pixel with the constant current in a shorter section than the constant current section shown in FIG. 1(*c*) to provide the selected pixel with the constant current as shown in FIG. 1(*d*). In the remaining section of the selection period, is the switch 41 is placed in the state to disconnect the constant-current circuit 42 and the anode strip 2 to put the anode strip 2 in the high impedance state. The potential of a selected cathode strip 1 is at 0V (ground potential) as the selection voltage, and the potential of the non-selected cathode strips 1 is at a higher potential than the selection voltage.

When pixels are energized to emit light with a luminance of 50%, the length of the constant current section is set so that the amount of the electric charges that pass through an organic electroluminescent light emitting element in the selection period is half of the amount of the electric charges that pass through the organic electroluminescent light emitting element in the selection period when the pixels are energized to emit light with a luminance of 100%. In a case of a gray scale having any other luminance than a luminance 100% as well, the length of the constant current section is set so that the amount of the electric charges that pass through an organic electroluminescent light emitting element in the selection period decreases by the difference in comparison with the amount of the electric charges that pass through the organic electroluminescent light emitting element in the selection period when pixels are energized to emit light with a luminance of 100%.

In order to set the selection period in the electric charge control driving at the same length as the selection period in the conventional method, when the constant current section in the electric charge control driving is ½ of the constant current section in the conventional method, it is sufficient that the value of the current supplied from the constant-current circuit 41 is set to be substantially doubled in comparison with the value of that in the conventional method.

The electric charges that are supplied from the constant-current circuit 41 in the constant current section are accumulated in the capacitance of all pixels in one column, and the selected pixel allows the electric charges therein to pass therethrough according to its diode characteristics. The selected pixel is energized to emit light by the electric charges passing therethrough. In the electric charges that have been accumulated in the capacitance of all pixels in one column in the high impedance section pass through the selected pixel according to the diode characteristics of the selected pixel. Thus, the selected pixel continues to emit light even in the high impedance section.

On the assumption that the potential of the anode strips 2 at the end of the selection period is $V_{REST}$, electric charges, the amount of which is determined by $V_{REST}$ and the capacitance $C_{colm}$ in one column, are expected to stay in the capacitance of the pixels in the one column. Hereinbelow, the amount of the electric charges that stay in the pixels in one column at the end of the selection period is referred to as the residual electric charge amount. The amount of electric charges that have been supplied to one column from the constant current circuit 42 in the constant current section in the selection period is referred to as the supplied electric charge amount.

Figure 9B:
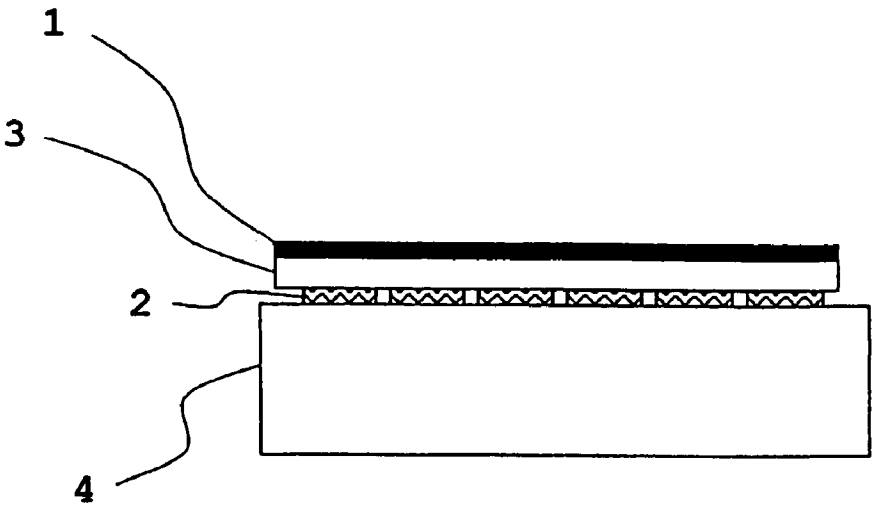
FIGS. 9(*a*) and 9(*b*) are a perspective view showing an organic electroluminescent display device and a cross-sectional view of the device respectively.
Figure 9A:
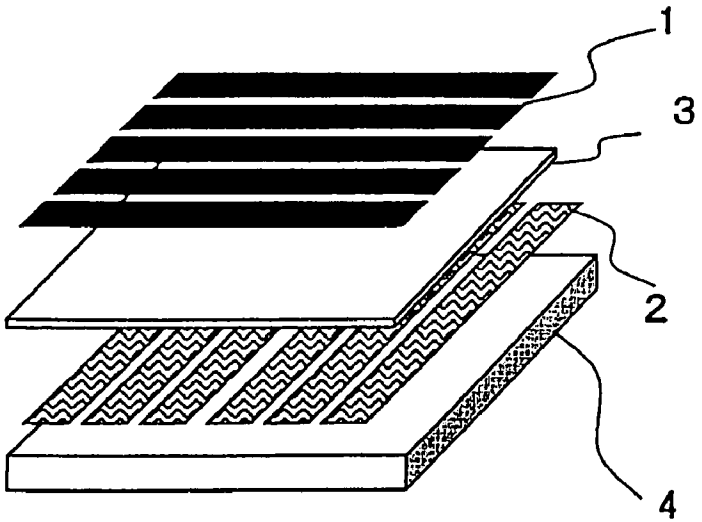
Figure 10:
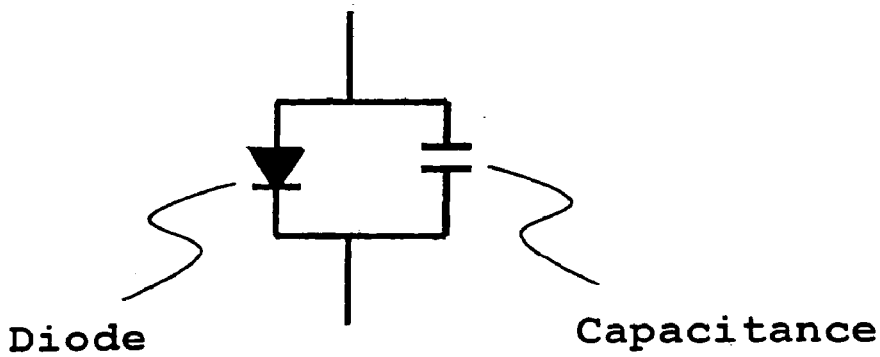
FIG. 10 is an equivalent circuit diagram of an organic electroluminescent element.
Figure 11:
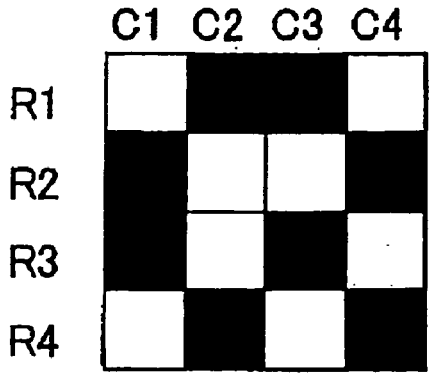
FIG. 11 is an explanatory diagram showing one example of a display pattern.
Figure 12:
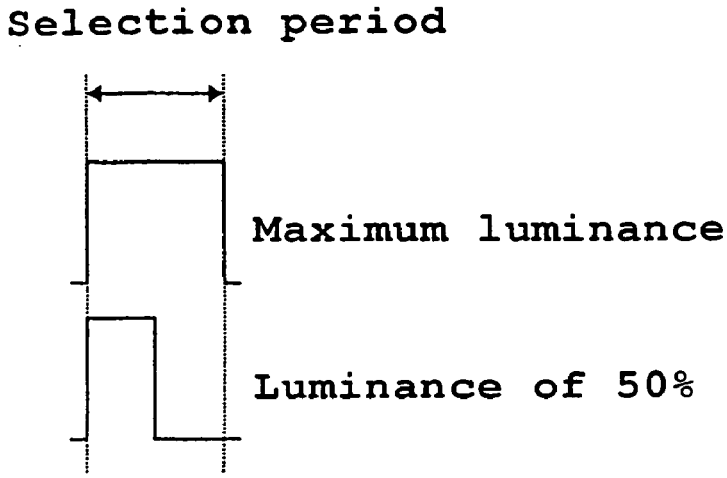
FIG. 12 is a waveform diagram showing one example of a driving waveform.
Figure 15A:
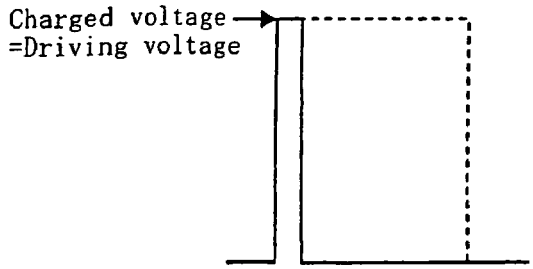
FIGS. 15(*a*) and 15(*b*) are waveform diagrams showing examples of applied voltages when a pixel is energized so as to emit light by PWM according to conventional method.
Figure 15B:
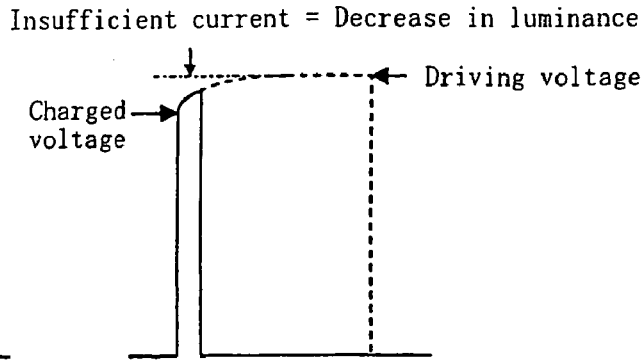

Now, the reason why chrominance non-uniformity is reduced according to the electric charge control driving will be explained. Although the structure of an organic electroluminescent display according to the present invention is basically similar to the structure of the conventional organic electroluminescent display shown in FIGS. 9(*a*) and 9(*b*), it is preferable that the organic electroluminescent element used in the organic electroluminescent display according to the present invention has lesser voltage-dependence in luminous efficiency to a passing current (emission luminance/current density).

Figure 4:
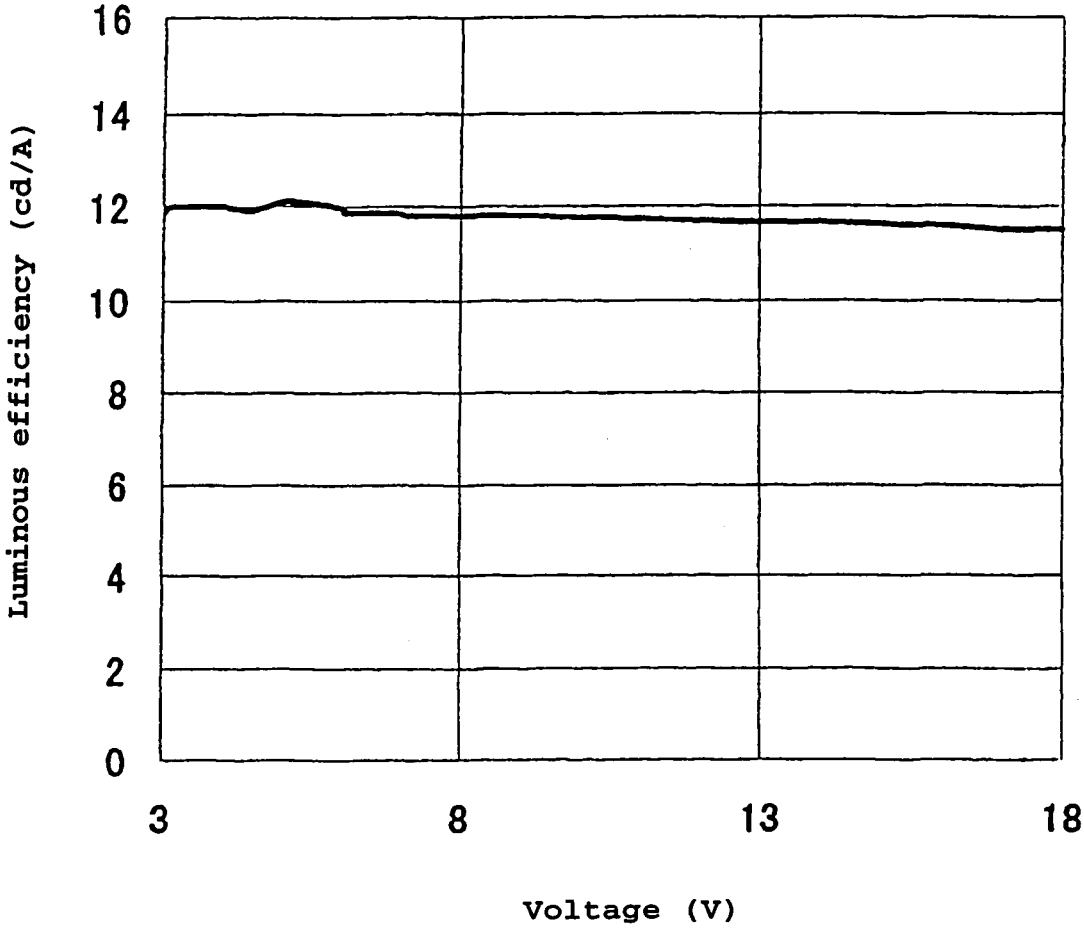
FIG. 4 is an explanatory view showing an example of the characteristics of an organic electroluminescent element having a small voltage-dependency in luminous efficiency.
Figure 5:
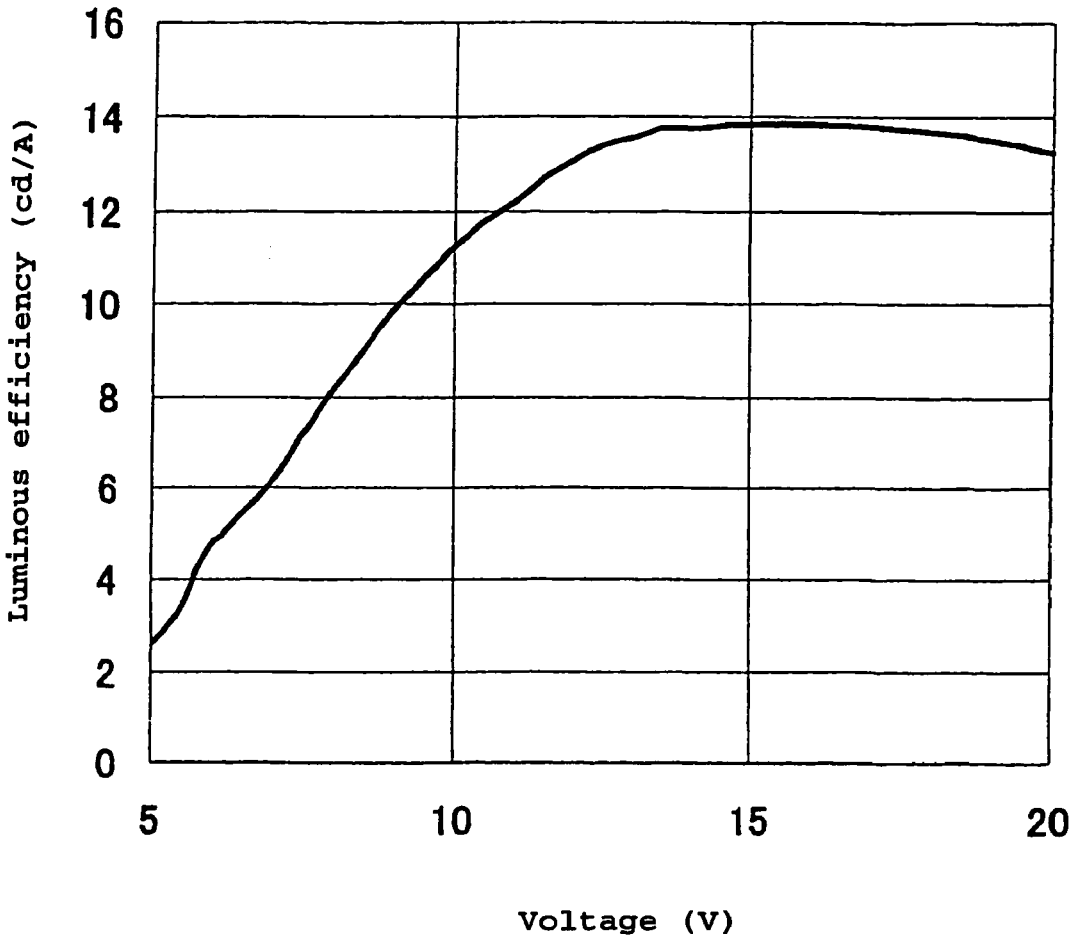
FIG. 5 is an explanatory diagram showing an example of the characteristics of an organic electroluminescent element containing copper phthalocyanine.

When the hole injection layer of the organic electroluminescent element contains an organic polymeric material, the organic electroluminescent element can have a substantially constant luminescent efficiency irrespective of a voltage applied to the pixels. FIG. 4 shows an example of the characteristics of an organic electroluminescent element having less voltage-dependence in luminous efficiency. FIG. 5 shows an example of the characteristics of an organic electroluminescent element having a hole injection layer made of copper phthalocyanine. In each of FIG. 4 and FIG. 5, the horizontal axis designates a voltage applied to the pixels, and the vertical axis designates luminous efficiency. In the characteristics shown in FIG. 4, the degree of variations ((the maximum value−the minimum value)/the minimum value) in the luminous efficiency is less than 10% in a voltage range of 15V from 3 to 18V. In general, the range from 3 to 18V may contain the range of voltages, which are applied across the anode and the cathode of an organic electroluminescence element in the selection period (except the rising time of a voltage applied to pixels in the selection period, i.e., the period that is required until the voltage across the anode and the cathode of the organic electroluminescent element has attained a substantially stable state.

As shown in FIGS. 1(*c*) and (*d*), the voltage applied to pixels is not constant in the constant current section in the case of the electric charge control driving. However, the luminous efficiency becomes substantially constant irrespective of applied voltages by using an organic electroluminescent element having the characteristics shown as an example in FIG. 4. That is to say, when the same amount of current flows in the selection period, the same amount of light emission can be obtained in the selection period irrespective of applied voltages. In other words, a selected pixel emit an amount of light emission according to the amount of electric charges that have passed through the organic electroluminescent element in the selection period. Hereinbelow, the amount of electric charges that pass the organic electroluminescent element is referred to as an element-passing electric charge amount. The element-passing electric charge amount means (the amount of supplied electric charges−the amount of residual electric charges).

When the amount of element-passing electric charges is constant in respective gray scale levels, the amount of light emission in the respective gray scale levels in the selection period becomes constant. By setting the amount of element-passing electric charges according to a difference in the gray scale levels, it is possible to obtain a desired grayshade. The amount of supplied electric charges can be easily set since the amount of supplied electric charges is determined by the value of an output current from the constant-current circuit 42 and the length of the constant current section. It is difficult to control the amount of residual electric charges. However, if it is possible to estimate $V_{REST}$, it is possible to substantially accurately estimate the amount of residual electric charges since it is easy to see the capacitance $C_{colm}$ in one column.

The amount of element-passing electric charges in the respective gray scale levels may be determined based on a required luminance for the respective gray scale levels. When the amount of element-passing electric charges and the amount of residual electric charges are determined for the respective gray scale levels, it is possible to make the amount of light emission constant in the respective gray scale levels by setting the amount of supplied electric charges at the value that is obtained by adding the amount of residual electric charges to the amount of element-passing electric charges, i.e., summing the amount of residual electric charges and the amount of element-passing electric charges. Thus, it is possible to reduce chrominance non-uniformity. As a result, it is also possible to reduce horizontal cross-talk. The constant current section corresponding to an amount of supplied electric charges, i.e., the driving pulse width, may be represented by the following formula:

$$\text{Driving Pulse Width} = C_1 \times \text{required luminance of gray scale level} + C_2 \qquad \text{Formula 1}$$

In Formula 1, $C_1$ is a constant, and $C_2$ is equal to an additional part (added part) corresponding to the amount of residual electric charges. $C_2$ is a value dependent on temperature and may vary depending on the ambient temperature of an organic electroluminescent element. Specifically, when the ambient temperature of an organic electroluminescent element is high, $C_2$ may be decreased. When the ambient temperature of the organic electroluminescent element is low, $C_2$ may be increased.

Figure 6:
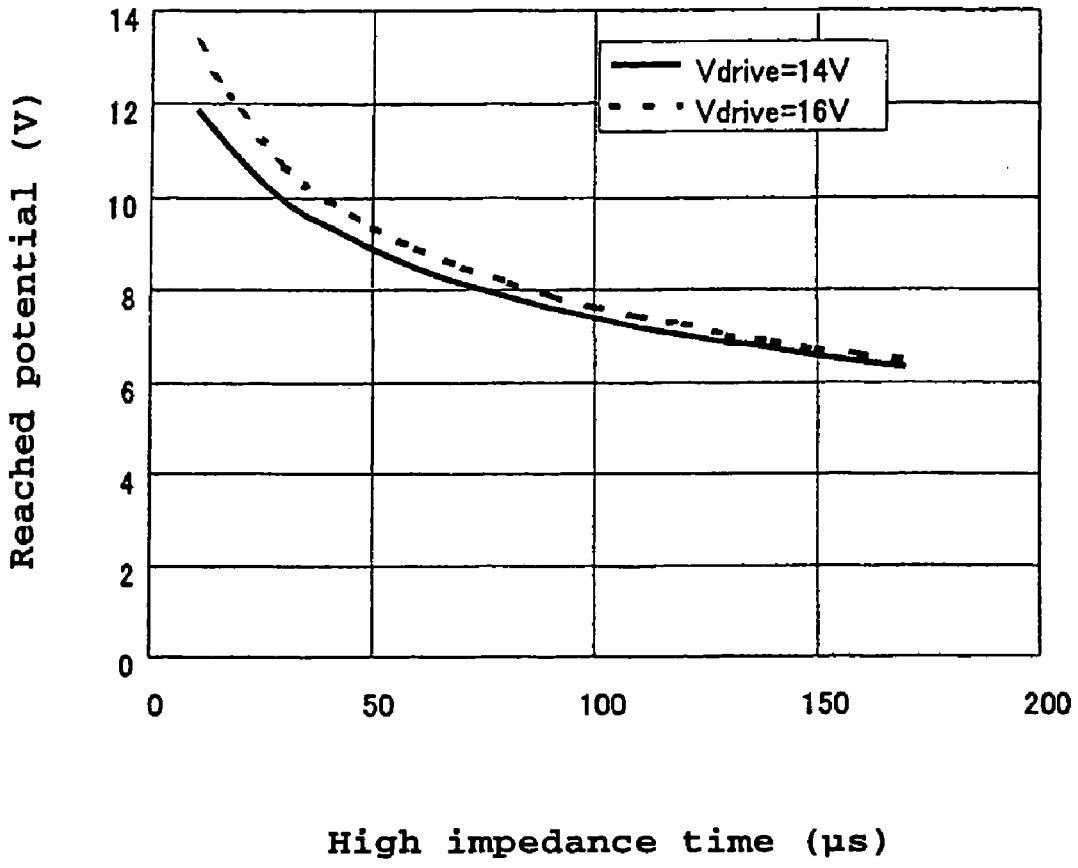
FIG. 6 is an explanatory diagram showing measurement results for the relationship between a reached potential and the length of a high impedance time.

In some cases, the potential $V_{drive}$ of the anode strips 2 at the start of the high impedance section varies because of, e.g., variations in the characteristics of an organic electroluminescent element. However, it is possible to obtain display on a display screen in a uniform fashion irrespective of variations in the potential $V_{drive}$ by setting the high impedance section so as to have a sufficiently long length. FIG. 6 is an explanatory diagram showing measurement results for the relationship between a reached voltage and the length of a high impedance section (high impedance time) in a case wherein an organic electroluminescent display device using an organic electroluminescent element having the characteristics shown in FIG. 4 was driven with a duty of 1/64 by the electric charge control driving. The reached voltage means the potential of the anode strips 2. The solid line in this figure designates measurement results that were obtained when the potential $V_{drive}$ of the anode strips 2 at the end of the constant current section, i.e., the start of the high impedance section, was 14V. The dotted line designates measurement results that were obtained when the potential $V_{drive}$ was 16V.

The reached voltages gradually lower with lapse of the high impedance time. Even in a case wherein $V_{drive}$ at the end of the constant current section varies, the difference between reached voltages is made quite smaller when the high impedance time as the length of a high impedance section is about 70 μs. When the high impedance time is beyond about 70 μs, the difference is made further smaller.

Figure 7:
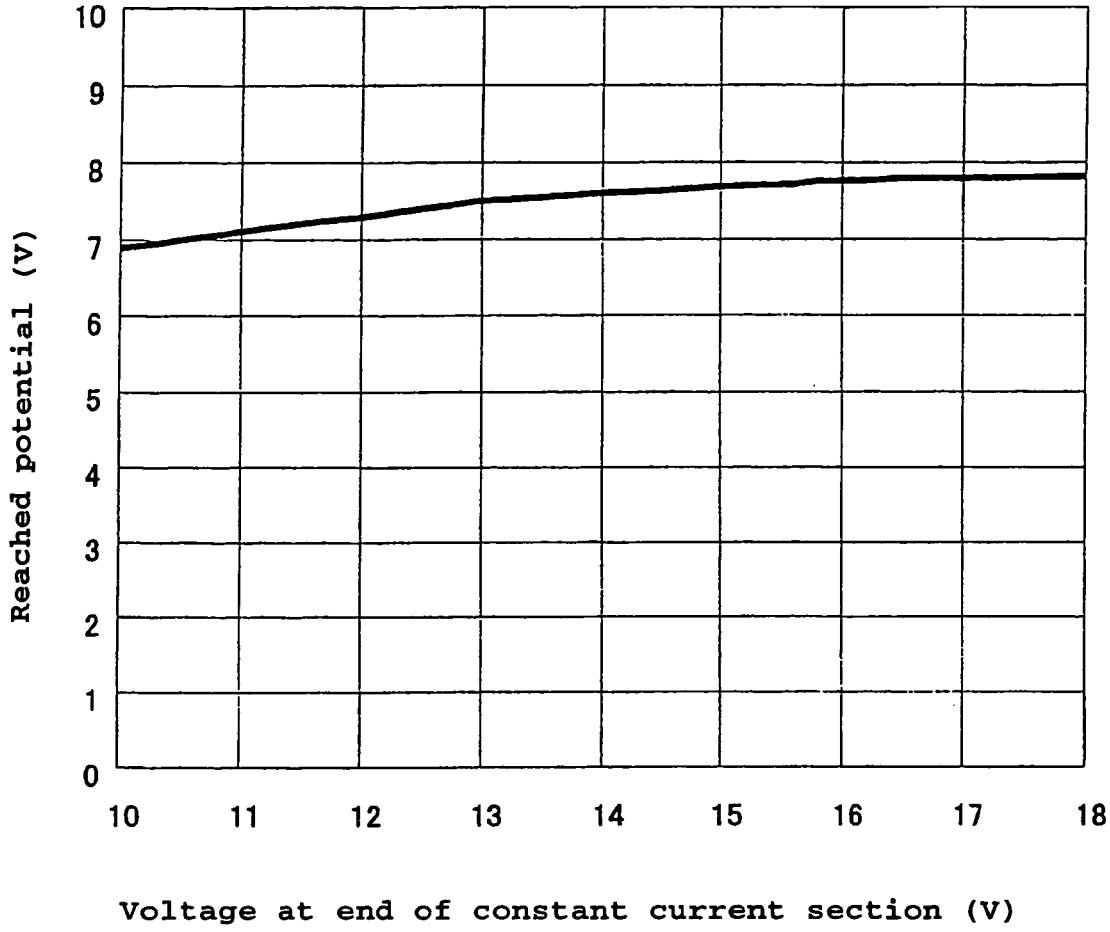
FIG. 7 is an explanatory diagram showing measurement results for the relationship between a reached potential and a voltage at anode strips at the end of a constant current section.

FIG. 7 is an explanatory diagram showing measurement results for the relationship between the potential of anode strips 2 and a reached voltage at the end of a constant current section in a case wherein an organic electroluminescent display device using an organic electroluminescent element having the characteristic shown in FIG. 4 was driven with a duty of 1/64 by the electric charge control driving, and the high impedance time was set at 94 μs. As shown in FIG. 7, the reached voltages at the end of the high impedance time of 94 μs were almost constant irrespective of the voltages at the anode strips 2 at the end of the constant current section.

Based on the measurement results shown in FIG. 6, reached potentials may be regarded as being substantially constant irrespective of variations in $V_{drive}$ as long as the high impedance time is beyond about 70 μs. For example, a specific reached potential may be estimated as being 7V based on the measurement results shown in FIG. 6. The amount of the residual electric charges can be calculated according to (reached potential×capacitance in one column). In the case of an organic electroluminescent display device using an organic electroluminescent element having the characteristics shown in FIG. 4, it is possible to estimate the amount of residual electric charges unambiguously irrespective of gray scale levels, and accordingly it is possible to determine $C_2$ in formula 1 unambiguously. Thus, it is possible to determine the amount of supply electric charges, i.e., the drive pulse width that is appropriate to the required luminescence for respective gray scale levels. By setting the drive pulse width appropriately, the amount of element-passing electric charges can have a value appropriate to each of the gray scale levels, suppressing chrominance non-uniformity in each of the gray scale levels.

Now, the driving parameters that can effectively utilize the driving method according to the present invention will be described, referring to FIG. 8. In the case of a small duty, almost neither chrominance non-uniformity nor horizontal cross-talk is caused even in a conventional method since the selection period can be lengthened. Specifically, in the case of a duty ratio of less than 1/32, the electric charge control driving is effective (see the straight line showing "Range wherein invention can offer its advantages in sufficient fashion" in FIG. 8). Since it is impossible to determine the high impedance time so as to cover the entire range of the selection period, there are limitations to the high impedance time according to a utilized duty (see to the curved line "Maximum value of high impedance time" in FIG. 8). Additionally, it is preferable that a section occupying at least about 20% of the selection period is allotted to the constant current section in the case of a frame frequency of 60 Hz for instant. From this viewpoint, there are limitations to the high impedance time (see to the curved line "Minimum value of high impedance time" in FIG. 8).

Figure 8:
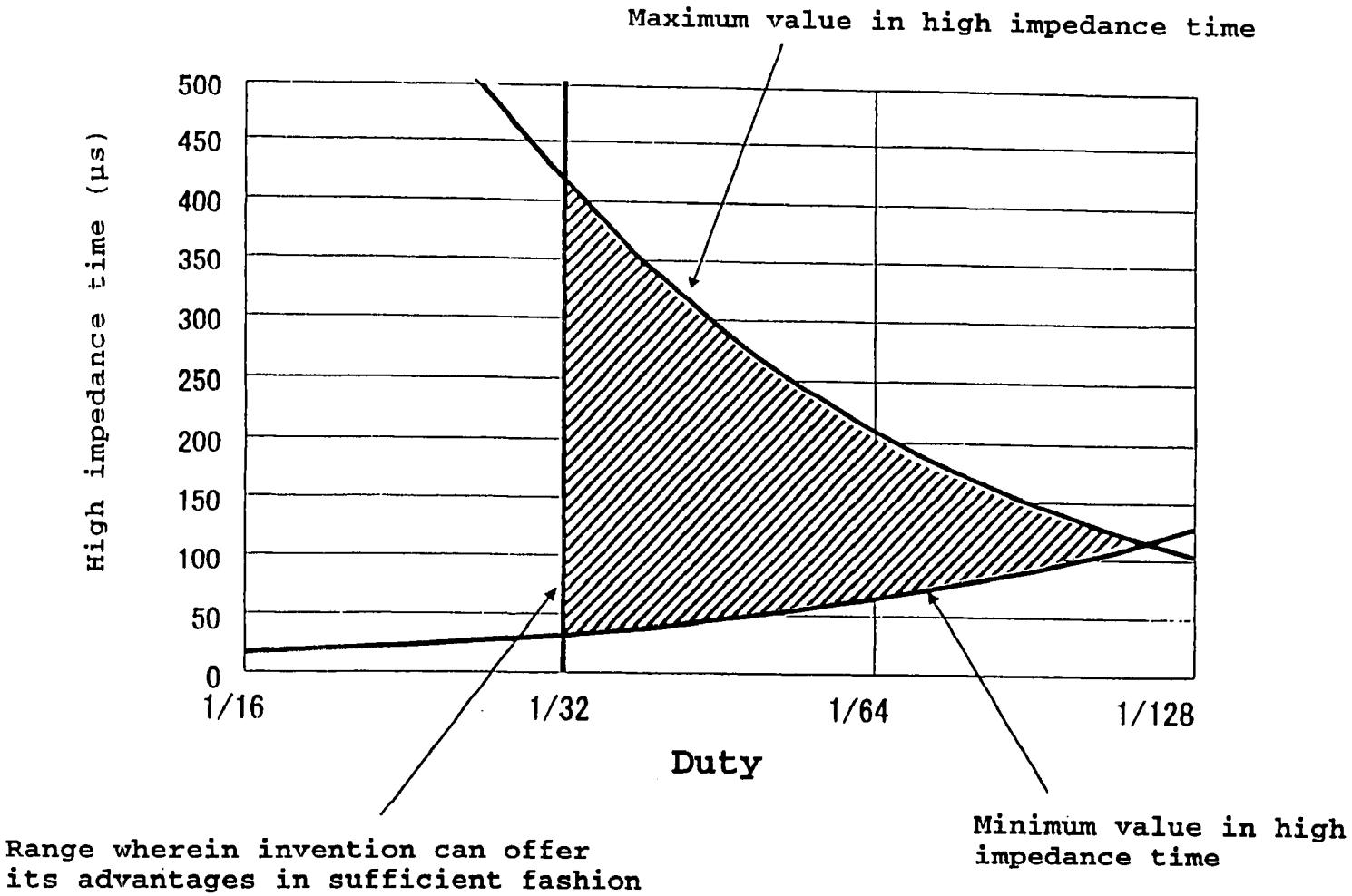
FIG. 8 is an explanatory diagram explaining a range wherein the electric charge control driving can be effectively utilized.

In sum, the driving method according to the present invention can be effectively utilized in the hatched region in FIG. 8. In other words, this region ranges from a duty ratio of less than 1/32 to a duty ratio of greater than 1/128 (an area on the left side with respect to the duty ratio of 1/128 in FIG. 8) and from a high impedance time occupying a length of greater than 0% of the selection period to a high impedance time occupying a length of not greater than 80% of the selection period. In practice, it is preferable that the high impedance time is not shorter than about (1/duty ratio) μs and occupies a length of 80% or less of the selection period as stated earlier. When the frame frequency is 120 Hz or lower, the high impedance time may be set so as to occupy ½ of the selection period as long as the duty ratio is greater than 1/64. When the frame frequency is 70 Hz or lower, the high impedance time may be set so as to occupy a length of ½ of the selection period as long as the duty ratio is 1/84 or more.

In this embodiment, in order to drive an organic electroluminescent display device by passive matrix addressing, an organic electroluminescent element having a small voltage-dependency in luminous efficiency is used in the organic electroluminescent display device, and the high impedance section is set following the constant current section in a selection period as stated earlier. By this arrangement, it is possible to reduce chrominance non-uniformity and horizontal cross-talk in a low gray scale level in the case of, in particular, PWM. In other words, it is possible to improve display quality. Although the degree of variations in luminous efficiencies is 10% or less in the range of voltages applicable to a pixel in the selection period as shown in FIG. 4, it is conceivable that the electric charge control driving can be practically utilized as long as the degree of variations is about 15% in that range.

Additionally, it is possible to reduce power consumption since capacitive charge is not performed. This advantage becomes noticeable, in particular, when the number of pixels to turn on is small, i.e., when the ratio of pixels to turn on is low.

Now, examples of the electric charge control driving will be shown.

EXAMPLE 1

An organic electroluminescent element for passive matrix addressing was provided on a glass substrate. Specifically, an ITO film was deposited on the glass substrate so as to have a film thickness of 200 nm, and the deposited film was etched to form anode strips 2. A film of chrome (Cr) and a film of aluminum (Al) were deposited so as to have a layered structure having a film thickness of 300 nm, and the deposited layered structure was etched to form wiring in the organic electroluminescent element. On the etched structure, photosensitive polyimide was applied as an insulating film, and the applied film was exposed and developed to form openings working as light emitting portions of respective pixels. On the structure thus layered, a thin film was deposited to form a hole injection layer as an organic electroluminescent layer by a wet application method using an organic solvent containing PTPDEK as an organic polymeric material, PTPDEK is manufactured by Chemipro Kasei Kaisha, Ltd. for example. The weight-average molecular weight of PTPDEK is 1,000 or more. The organic solvent needs to contain 50 wt % or more of PTPDEK.

Additionally, on the structure thus fabricated, organic electroluminescent layers were layered by vapor deposition. Specifically, for formation of a hole transport layer, a film of α-NPD was deposited so as to have a film thickness of 100 nm. Next, for formation of a light emitting layer made of an organic luminescent material, a film of Alq as a host compound and a film of coumarin as a fluorescent pigment of a guest compound were simultaneously formed so as to have a film thickness of 30 nm by vapor deposition. On the light emitting layer, a film of Alq was formed so as to have a film thickness of 30 nm for formation of an electron transport layer by vapor deposition, and a film of LiF was additionally formed so as to have a film thickness of 0.5 nm as a cathode interface layer. Finally, a film of Al was deposited to form scanning electrodes as the cathode strips 1, and the scanning electrodes were connected to cathode wiring. Next, in order to protect the organic electroluminescent layers from moisture, an additional glass substrate was provided so as to confront the glass substrate stated earlier, both substrates were bonded by a peripheral seal, a dry nitrogen gas was sealed in the portion encapsulated by the glass substrates and the peripheral seal.

The organic electroluminescent element thus fabricated was connected to a drive circuit to make an organic electroluminescent display device. The pixel arrangement was 96 (columns)×64 (rows), and a pixel pitch was 0.35 mm×0.35 mm. The organic electroluminescent display device was energized at a frame frequency of 86 Hz and with a duty of 1/64 by the electric charge driving. The number of the gray scale levels was set at 16 (including a black level). An ML9361 product manufactured by Oki Electric Co., Ltd. was used as the data driver 4.

In the electric charge driving, the length of the selection period (selection time) was 182 μs, while the idle period was set at a length of 6 μs. As shown in Table 1, the driving current was 0.6 mA per one column. The current application section at the time of the maximum gray scale level as the constant current section at the time of the maximum luminance was set to have a length of 98 μs. The current application section at the time of the minimum gray scale level except the black level was set to have a length of 11.5 μs. The luminance at the time of the minimum gray scale level was smaller than 1/15 of the maximum luminance since a reverse gamma correction was taken into account. The high impedance time as the length of the high impedance section at the time of the maximum gray scale level was set at 78 μs, i.e., 43% of the selection time. In this example, the added pulse width corresponding to $C_2$ in formula 1 was set at 10.8 μs.

The electric charge driving was performed under the conditions stated above. It was revealed that chrominance non-uniformity was not visually recognized and that no cross-talk was caused.

TABLE 1

| | Example 1 | Example 2 |
|---|---|---|
| Driving method | Electric charge control driving | Electric charge control driving |
| Gray scale method | PWM | PWM |
| Driving current (mA/pixel) | 0.6 | 1.2 |
| Shortest high impedance time (μs) | 78 | 127 |
| Ratio of short high impedance time (μs) | 43% | 70% |
| Current application time at maximum gray scale level (μs) | 98 | 49 |
| Current application time at minimum gray scale (μs) | 11.5 | 5.8 |
| Added pulse width (μs): $C_2$ | 10.8 | 5.4 |
| Results | Neither cross-talk nor chrominance non-uniformity | Neither cross-talk nor chrominance non-uniformity |

EXAMPLE 2

The organic electroluminescent element used in Example 1 was also used and energized at a frame frequency of 86 Hz and with a duty of 1/64 by the s electric charge control driving. The number of the gray scale levels was set at 16 (including a black level). As shown in Table 1, the driving current was 1.2 mA per one column. The current application section at the maximum gray scale level as the constant current section at the time of maximum luminance was set to have a length of 127 s. The current application section at the minimum gray scale except the black level was set to have a length of 5.8 μs. The impedance time at the maximum gray scale level was set at 49 μs, i.e., 70% of the selection time. The added pulse width was set at 5.4 μs.

The electric charge driving was performed by the conditions stated above. It was revealed that chrominance non-uniformity was not visually recognized and that no cross-talk was caused.

COMPARATIVE EXAMPLE 1

The organic electroluminescent element used in Example 1 was energized by conventional reset driving. The frame frequency was set at 86 Hz, the duty ratio was set at 1/64, and the number of the gray scale was set at 16 (including a black level). As shown in Table 2, the driving current was 0.3 mA per one column, which is half of the driving current in Example 1.

In this case, horizontal cross-talk was recognized. In the case of an organic electroluminescent element that was fabricated as in Example 1 and had an unequal distribution in the driving voltages, chrominance non-uniformity was recognized at the time of a low gray scale. The unequal distribution in the driving voltages means that there are variations in the current-voltage characteristics of the pixels in an organic electroluminescent element.

TABLE 2

| | Comparative Example 1 | Comparative Example 2 |
|---|---|---|
| Driving method | Reset driving | Electric charge control driving |
| Gray scale method | PWM | PWM |
| Driving current (mA/pixel) | 0.3 | 0.4 |
| Shortest high impedance time (μs) | 0 | 29 |
| Ratio of short high impedance time (μs) | 0% | 16% |
| Current application time at maximum gray scale level (μs) | 176 | 147 |
| Current application time at minimum gray scale (μs) | 1.3 | 18 |
| Added pulse width (μs): $C_2$ | 0 | 16.2 |
| Results | Horizontal cross-talk was caused. Chrominance non-uniformity was caused at low gray scale in panel having unequal distribution in driving voltages | Horizontal cross-talk was caused. Chrominance non-uniformity was not caused. |

COMPARATIVE EXAMPLE 2

The organic electroluminescent element used in Example 1 was also used and driven at a frame frequency of 86 Hz and with a duty of 1/64 by the electric charge control driving. The number of gray scale level was set at 16 (including a black level). As shown in Table 2, the driving current was 0.4 mA are one column. The current application time at the maximum gray scale level as the constant current section at the maximum luminance was set at 147 s, and the current application time at the minimum gray scale level except the black level was set at 18 μs. Additionally, the high impedance time at the maximum gray scale level was set at 29 μs, i.e., 16% of the selection time. The added pulse width was set at 16.2 μs.

In this case, horizontal cross-talk was visually recognized, though chrominance non-uniformity was not recognized.

In accordance with the driving method of the present invention, it is possible to improve the display quality of an organic electroluminescent display device. It is also possible to reduce power consumption, in particular, when the ratio of pixels to emit light is small.

The entire disclosure of Japanese Patent Application No. 2002-350519 filed on Dec. 2, 2002 including specification, claims, drawings and summary is incorporated herein by reference in its entirety.

What is claimed is:

1. A method for driving an organic electroluminescent display device, which includes an organic electroluminescent element between a set of scanning strips and a set of data strips, both sets crossing each other, and a data driver connected to the respective data strips provided with a constant current circuit, and which is driven by passive matrix addressing, comprising:

placing a data strip in a high impedance state after supplying a constant current to the data strip from the constant current circuit in a selection period for applying a selection voltage to a scanning strip; and providing an organic electroluminescent element, the organic electroluminescent element having luminous efficiencies with respect to currents flowing therethrough falling in a variation range in a range of voltages applied across an anode and a cathode of the organic electroluminescent element, the applied voltages ranging from a voltage applied at an end of a rising time of voltage application to a voltage applied at an end of the high impedance section in the selection period.

2. The method according to claim 1, wherein the variation range is 15%.

3. The method according to claim 2, wherein the organic electroluminescent element has a hole injection layer, which contains 50 wt % or more of organic polymeric material having a weight-average molecular weight of 1,000 or more.

4. The method according to claim 1, further comprising:

setting a frame frequency at 120 Hz or lower and a duty ratio at 1/32 to 1/28; and setting a length of the high impedance section at (1/duty ratio) μs or longer.

5. A method for driving an organic electroluminescent display device, which includes an organic electroluminescent element between a set of a plurality of scanning strips and a set of a plurality of data strips, both sets crossing each other, a data driver connected to the data strips, and a constant current circuit connected to the data driver, and which is driven by passive matrix addressing, comprising:

placing a data strip in a high impedance state after supplying a constant current to the data strip from the constant current circuit in a selection period for applying a selection voltage to a scanning strip;

performing grayshade display by PWM; and supplying an amount of electric charge to the data strip in a constant current section when pixels emit light at respective gray scale levels, the amount of electric charge being calculated by adding an amount of residual electric charge to an amount of electric charge corresponding to a luminance required for the respective gray scale levels, the amount of residual electric charge being found based on an estimated potential at the data strip at an end of the high impedance section.

6. The method according to claim 5, further comprising varying the added amount of electric charges according to ambient temperature of the organic electroluminescent element.

7. The method according to claim 5, wherein the organic electroluminescent element has a hole injection layer, which contains 50 wt % or more of organic polymeric material having a weight-average molecular weight of 1,000 or more.

8. The method according to claim 5, further comprising:

setting a frame frequency at 120 Hz or lower and a duty ratio at 1/32 to 1/28; and setting a length of the high impedance section at (1/duty ratio) μs or longer.

* * * * *